US009451867B2

(12) United States Patent
Beshears, Jr. et al.

(10) Patent No.: US 9,451,867 B2
(45) Date of Patent: Sep. 27, 2016

(54) DISHWASHER AND OZONE GENERATOR

(71) Applicant: Whirlpool Corporation, Benton Harbor, MI (US)

(72) Inventors: Paul E. Beshears, Jr., Stevensville, MI (US); Jacob R. Karhoff, Kentwood, MI (US); Prithi Rao, Stevensville, MI (US); Mark M. Senninger, Saint Joseph, MI (US); Elliott V. Stowe, Stevensville, MI (US); Tremitchell Wright, Elkhart, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 151 days.

(21) Appl. No.: 13/742,569

(22) Filed: Jan. 16, 2013

(65) Prior Publication Data

US 2013/0192642 A1 Aug. 1, 2013

Related U.S. Application Data

(60) Provisional application No. 61/590,833, filed on Jan. 26, 2012.

(51) Int. Cl.
*A47L 15/42* (2006.01)
*A47L 15/23* (2006.01)

(52) U.S. Cl.
CPC ..... *A47L 15/424* (2013.01); *A47L 15/4219* (2013.01); *A47L 15/23* (2013.01); *A47L 2401/06* (2013.01); *A47L 2401/07* (2013.01)

(58) Field of Classification Search
CPC ..... A47L 15/242; A47L 15/4219; A47L 15/0039; A47L 15/4208; A47L 15/4238; A47L 15/424; A47L 2601/08
USPC ..... 134/104.1, 18, 25.2
See application file for complete search history.

(56) References Cited

U.S. PATENT DOCUMENTS

| | | | | |
|---|---|---|---|---|
| 5,529,683 | A | 6/1996 | Critz et al. | |
| 6,918,397 | B2 | 7/2005 | Lin et al. | |
| 7,493,782 | B2 | 2/2009 | Daniels | |
| 7,594,513 | B2 | 9/2009 | VanderRoest et al. | |
| 2003/0004084 | A1 * | 1/2003 | Sato | B01D 61/04 510/403 |

(Continued)

FOREIGN PATENT DOCUMENTS

| | | | | |
|---|---|---|---|---|
| DE | 3232057 | A1 * | 3/1984 | A47L 15/0002 |
| DE | 60004060 | T2 | 4/2004 | |

(Continued)

OTHER PUBLICATIONS

Tatapudi et al., Simultaneous Synthesis of Ozone and Hydrogen Peroxide in a Proton-Exchange-Membrane Electrochemical Reactor, The Electrochemical Society, vol. 141, Issue 5, pp. 1174-1178 (May 1994).*

(Continued)

*Primary Examiner* — Douglas Lee

(57) ABSTRACT

A dishwasher comprising a tub at least partially defining a treating chamber in which liquid may be sprayed from at least one sprayer for the treating of dishes within the treating chamber. A liquid recirculation system may be provided for recirculating the sprayed liquid back to the at least one sprayer. An ozone generator may be provided in communication with the treating chamber to supply ozone to the treating chamber.

10 Claims, 4 Drawing Sheets

(56) References Cited

U.S. PATENT DOCUMENTS

| | | | | |
|---|---|---|---|---|
| 2005/0017114 | A1* | 1/2005 | Gadini | A47L 15/4229 242/375.1 |
| 2007/0251549 | A1 | 11/2007 | Heiligenmann et al. | |
| 2009/0283111 | A1* | 11/2009 | Classen | A47L 15/4206 134/10 |
| 2010/0000577 | A1 | 1/2010 | Heiligenmann et al. | |
| 2010/0095715 | A1 | 4/2010 | Ulger et al. | |
| 2010/0181208 | A1* | 7/2010 | Denison | A47L 15/42 205/687 |
| 2011/0017235 | A1 | 1/2011 | Berner et al. | |
| 2011/0203620 | A1* | 8/2011 | Ulger | A47L 15/424 134/184 |
| 2011/0226292 | A1 | 9/2011 | Ulger et al. | |

FOREIGN PATENT DOCUMENTS

| | | | | |
|---|---|---|---|---|
| DE | 102011054483 | A1 | 6/2012 | |
| EP | 1256308 | B1 | 8/2004 | |
| JP | 2001070764 | A | 3/2001 | |
| JP | 2003024692 | A | 1/2003 | |
| KR | 920007734 | B1 | 9/1992 | |
| WO | WO 2009141323 | A1 * | 11/2009 | A47L 15/0015 |
| WO | WO 2010049318 | A1 * | 5/2010 | A47L 15/424 |

OTHER PUBLICATIONS

Tatapudi et al., Simultaneous Synthesis of Ozone and Hydrogen Peroxide in a Proton Exchange Membrane Electrochemical Reactor, The Electrochemical Society, vol. 141, Issue 5, pp. 1174-1178 (May 1994).*

Tatapudi et al., Simultaneous Synthesis of Ozone in Proton Exchange Membrane Electrochemical Reactor, The Electrochemical Society, vol. 141, Issue 5, pp. 1174-1178 (May 1994).*

Machine translation of WO 2009/141323A1 to Heiligenmann dated Nov. 2009.*

German Search Report for Counterpart DE102013100626, Sep. 10, 2013.

* cited by examiner

DISHWASHER AND OZONE GENERATOR

CROSS-REFERENCE TO RELATED APPLICATIONS

This application claims the benefit of U.S. Provisional Patent Application No. 61/590,833, filed Jan. 26, 2012, which is incorporated herein by reference in its entirety.

BACKGROUND

Dishwashers include a treating chamber in which dishes are placed to be treated according to an automatic cycle of operation. Various treating aids, such as detergents, stain removers, rinse aids, odor removers and sanitizing agents may be applied to the dishes during a cycle of operation. One example of a sanitizing agent is ozone, which may be generated in a variety of different ways to provide ozone gas and/or ozone gas dissolved in liquid. One method for generating ozone is through the electrolysis of water. Electrolytic ozone generators, such as polymer electrolyte or proton exchange membrane (PEM) cells, typically have narrow passage ways that can become easily clogged with debris. In addition, scale and other material can build-up within the electrolytic cell, decreasing the efficiency of the ozone generator.

SUMMARY

According to an embodiment of the invention, a dishwasher for treating dishes according to at least one cycle of operation comprises a tub at least partially defining a treating chamber, a spray system spraying liquid into the treating chamber, a recirculation system recirculating the sprayed liquid back to the spray system to define a liquid recirculation path, an ozone generator having a proton exchange membrane positioned within the liquid recirculation path to generate ozone from the liquid and a reverse flow system fluidly coupling the recirculation system and the ozone generator to selectively reverse the flow of the liquid through the proton exchange membrane.

According to another embodiment of the invention, a dishwasher for treating dishes according to a cycle of operation comprises a tub at least partially defining a treating chamber, a sprayer located in the treating chamber and having first and second sets of openings through which liquid may be emitted and sprayed into the treating chamber, a liquid recirculation system having a pump fluidly coupled to the tub and a recirculation circuit fluidly coupling the pump to the first set of openings, and an ozonating system comprising an ozone generator and an ozonating circuit fluidly coupling the ozone generator to the second set of openings. The ozone may be introduced into the chamber through the ozonating circuit independently of the recirculation circuit.

DESCRIPTION OF EMBODIMENTS OF THE INVENTION

While the embodiments of the invention are illustrated in the context of a dishwasher having a single treating chamber, it is also within the scope of the invention for the embodiments of the invention to be used in a dishwasher having multiple treating chambers.

Figure 1:
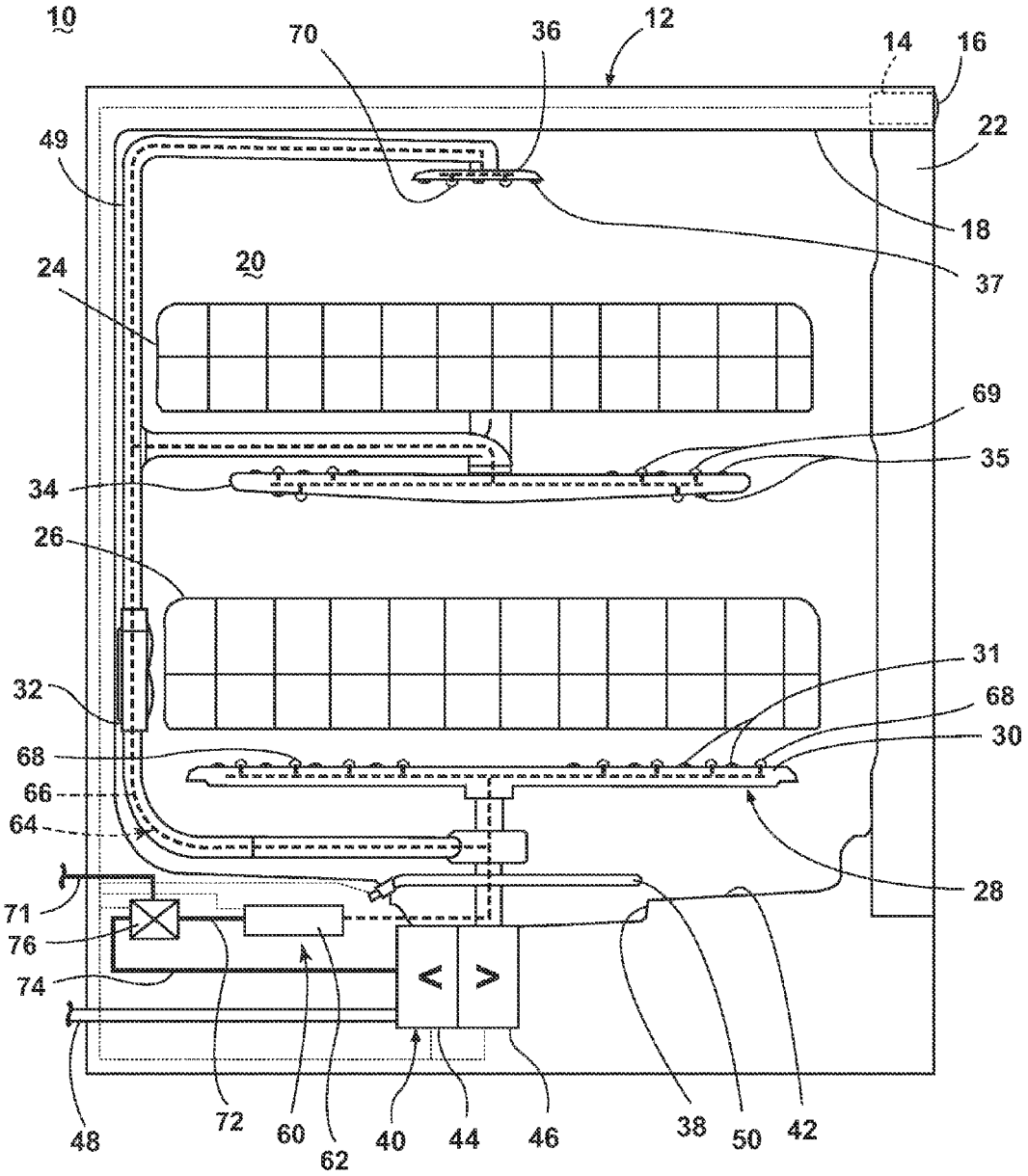
FIG. 1 is a schematic cross-sectional view of an automatic dishwasher according to a first embodiment of the invention.

FIG. 1 is a schematic cross-sectional view of an automatic dishwasher 10 according to one embodiment of the invention, the dishwasher 10 having a cabinet 12 defining an interior. Depending on whether the dishwasher 10 is a stand-alone or built-in, the cabinet 12 may be a chassis/frame with or without panels attached, respectively. The dishwasher 10 shares many features of a conventional automatic dishwasher which will not be described in detail herein except as necessary for a complete understanding of the invention.

A controller 14 may be located within the cabinet 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the cabinet 12 and at least partially defines a treating chamber 20 with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20. Dish holders in the form of upper and lower racks 24, 26 are located within the treating chamber 20 and receive dishes for treatment. The racks 24, 26 are mounted for slidable movement in and out of the treating chamber 20 for ease of loading and unloading.

As used herein, the term "dish(es)" is intended to be generic to any item, single or plural, that may be treated in the dishwasher 10, including, without limitation; dishes, utensils, plates, pots, bowls, pans, glassware, and silverware. While not shown, additional dish holders, such as a silverware basket on the interior of the door 22 or within the upper and lower racks 24, 26, may also be provided.

A spray system 28 is provided for spraying liquid in the treating chamber 20 and is provided in the form of a first lower spray assembly 30, a second lower spray assembly 32, a mid-level spray arm assembly 34, and/or an upper spray arm assembly 36. Upper spray arm assembly 36, mid-level spray arm assembly 34 and first lower spray assembly 30 are located, respectively, above the upper rack 24, beneath the upper rack 24, and beneath the lower rack 26 and are illustrated as rotating spray arms. The second lower spray assembly 32 is illustrated as being located adjacent the lower dish rack 26 toward the rear of the treating chamber 20. The second lower spray assembly 32 is illustrated as including a vertically oriented distribution header or spray manifold. Such a spray manifold is set forth in detail in U.S. Pat. No. 7,594,513, issued Sep. 29, 2009, and titled "Multiple Wash Zone Dishwasher," which is incorporated herein by reference in its entirety. Each of the spray assemblies or sprayers 30, 34 and 36 may include a first set of openings 31, 35 and 37 through which liquid is emitted.

A liquid recirculation system may be provided for recirculating liquid from the treating chamber 20 to the spray system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46. Circulation of liquid from the sump 38 through the liquid recirculation system to the spray system 28 and back to the sump 38 may define a liquid recirculation circuit or flow path.

The drain pump 44 may draw liquid from the sump 38 and pump the liquid out of the dishwasher 10 to a household drain line 48. The recirculation pump 46 may draw liquid from the sump 38 and pump the liquid to the spray system 28 through a liquid supply tube 49 to supply liquid into the treating chamber 20 through the spray assemblies 30, 32, 34 and 36. While the pump assembly 40 is illustrated as having separate drain and recirculation pumps 44, 46, in an alternative embodiment the pump assembly 40 may include a single pump configured to selectively supply wash liquid to either the spray system 28 or the drain line 48, such as by configuring the pump to rotate in opposite directions, or by providing a suitable valve system. A heating system having a heater 50 may be located within or near a lower portion of the tub 18 for heating liquid contained therein.

The dishwasher 10 may also be provided with an ozonating system 60 for supplying ozone to the treating chamber 20. The ozonating system 60 includes an ozone generator 62 and an ozone spraying system 64 which provides an ozone circuit or flow path for delivering ozonated water to the treating chamber 20. The ozone generator 62 may be a proton exchange, also known as a polymer electrolyte, membrane (PEM) type ozone generator which uses one or more electrolytic cells to generate ozone in situ in water to provide ozonated water. As used herein, ozonated water includes water and dissolved ozone gas and ozone gas that may have come out of solution and is no longer dissolved in the water. It will be understood that the application of ozonated water to a surface may include the application of a mixture of ozone gas dissolved in water and ozone gas which is not dissolved in water.

The ozone spraying system 64 includes an ozone supply tube 66 which fluidly couples the ozone generator 62 with the spray system 28 for selectively supplying ozonated water to each of the spray assemblies 30, 34 and 36. Each of the spray assemblies 30, 34 and 36 may include a second set of openings 68, 69, 70 fluidly coupled with the ozone supply tube 66 to supply ozonated water to the treating chamber 20. The ozone supply tube 66 may run adjacent to, but separate from, the liquid supply tube 49, such that the liquid drawn from the sump 38 does not flow through the ozone supply tube 66. In this manner, liquid from the ozone generator 62 is emitted through the second set of openings 68, 69, 70 independently of the liquid recirculation system.

The second set of openings 68, 69, 70 may be configured such that the pressure of the ozonated water emitted through the second set of openings 68, 69, 70 may provide at least some rotation to the spray assemblies 30, 34 and 36. Typically, the flow rate of the ozonated water flowing through the ozone supply tube 66 is much less than the flow rate of the liquid supplied by the recirculation pump 46. The dimensions of the second set of openings 68, 69, 70 may be configured such that the second set of openings 68, 69, 70 are smaller than the first set of openings 31, 35 and 37 to compensate for the smaller flow rate of liquid through the ozone spraying system 64. It is also within the scope of the invention for the spray assemblies 30, 34 and 36 to not rotate during emission of the ozonated water through the second set of openings 68, 69, 70. It will be understood that the first set of openings 31, 35 and 37 and the second set of openings 68, 69, 70 are illustrated schematically for the purposes of discussion and are not meant to limit the shape, design, size or number of openings in any way.

The dishwasher 10 may also include a liquid supply system for providing external liquid to the pump assembly 40, which selectively supplies liquid to the liquid recirculation system and/or the ozonating system 60. The liquid supply system may include a liquid supply conduit 71 extending from a liquid source, such as a household water supply. The liquid supply conduit 71 may branch into an ozone generator supply conduit 72 and a pump assembly supply conduit 74. The liquid supply conduit 71 may include a diverter valve 76 for selectively controlling the flow of liquid from the liquid source to the ozone generator supply conduit 72 and the pump assembly supply conduit 74. In this manner, fresh water from the liquid source may be selectively supplied to the ozone generator 62 independently of the liquid recirculation system.

Figure 2:
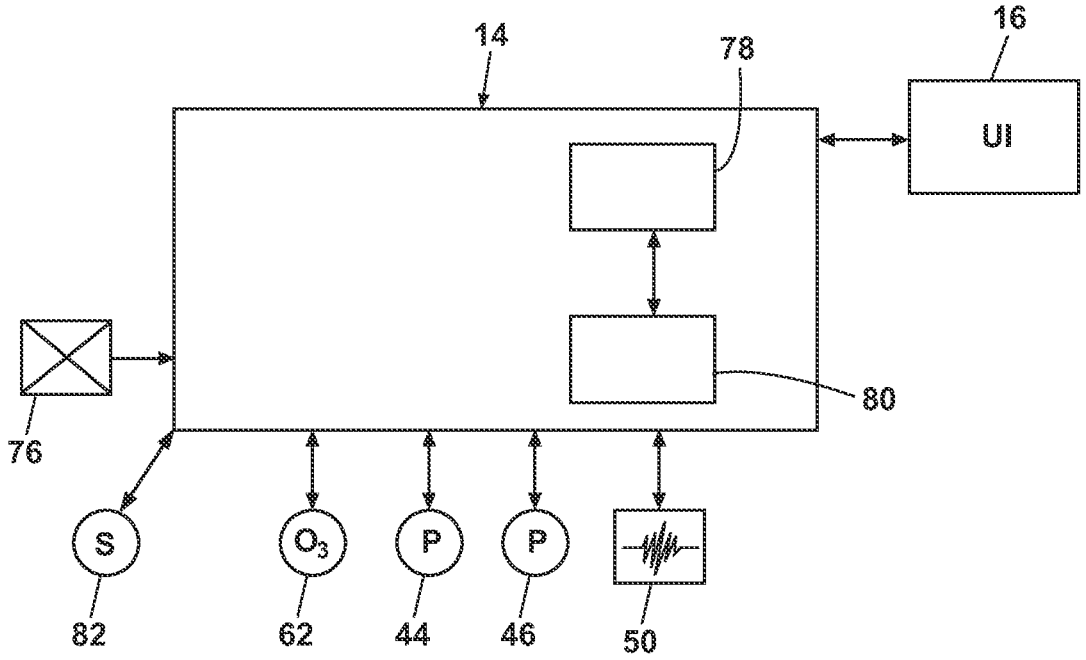
FIG. 2 is a schematic view of a controller of the dishwasher of FIG. 1.

As illustrated schematically in FIG. 2, the controller 14 may be coupled with the heater 50 for heating the wash liquid during a cycle of operation, the drain pump 44 for draining liquid from the treating chamber 20, the recirculation pump 46 for recirculating liquid during the cycle of operation, the diverter valve 76 for controlling the flow of water from the liquid supply, and the ozone generator 62 for controlling the generation of ozone. The controller 14 may be provided with a memory 78 and a central processing unit (CPU) 80. The memory 78 may be used for storing control software that may be executed by the CPU 80 in completing a cycle of operation using the dishwasher 10 and any additional software. For example, the memory 78 may store one or more pre-programmed cycles of operation that may be selected by a user and completed by the dishwasher 10. The controller 14 may also receive input from one or more sensors 82. Non-limiting examples of sensors that may be communicably coupled with the controller 14 include a temperature sensor and turbidity sensor to determine the soil load associated with a selected grouping of dishes, such as the dishes associated with a particular area of the treating chamber.

During a cycle of operation, water may be selectively provided by the diverter valve 76 from the liquid source to the pump assembly 40 through the pump assembly supply conduit 74. The recirculation pump 46 may pump the water received through the pump assembly supply conduit 74 to the spraying system 28 through the liquid supply tube 49 to be emitted into the treating chamber 20 through the first set of openings 31, 35 and 37 in each of the spray assemblies 30, 34 and 36, respectively, and the openings in the spray assembly 32 (not shown). Liquid and any debris removed from the items in the treating chamber 20 may collect in the sump 38 where the debris may be filtered and the liquid, with some debris still entrained, may be recirculated by the recirculation pump 46 back to the first set of openings 31, 35 and 37. Liquid may be recirculated through the liquid recirculation system and the spray system 28 one or more times, depending on the cycle of operation.

During a cycle of operation in which ozone is supplied to the treating chamber 20, the controller 14 controls the diverter valve 76 to provide water to the ozone generator 62 through the ozone generator supply conduit 72 and actuates the ozone generator 62 to generate ozone using the water supplied from the liquid supply. Ozonated water generated by the ozone generator 62 is provided to the ozonating system 60 through the ozone supply tube 66 where it may be emitted into the treating chamber 20 through the second set of openings 68, 69, 70 in the spray system 28. In this manner, the dishwasher 10 includes an ozonating system 60 having an independent ozonating circuit or flow path from the liquid source through the ozone generator 62 to the second set of openings 68, 69, 70 in the spray system 28 that is separate from the liquid recirculation circuit. Thus recirculated liquid collected in the sump 38 does not pass through the ozone generator 62.

Figure 3:
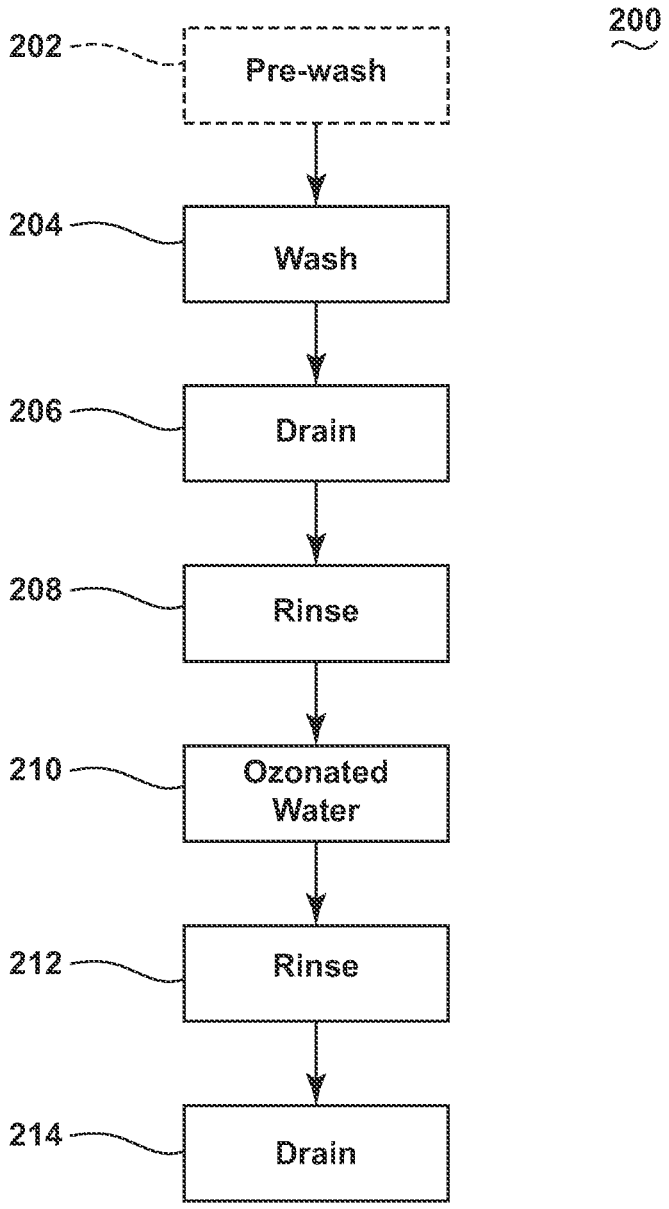
FIG. 3 is a flow chart illustrating a method of controlling a cycle of operation according to a second embodiment of the invention.

Referring now to FIG. 3, a flow chart of a method 200 for treating items in the dishwasher 10 with ozone according to a cycle of operation is illustrated. The sequence of steps depicted for this method and the proceeding methods are for illustrative purposes only, and is not meant to limit any of the methods in any way as it is understood that the steps may proceed in a different logical order or additional or intervening steps may be included without detracting from the invention.

The method 200 begins with assuming that items have been loaded into the upper and lower racks 24 and 26 and that a cycle of operation has been selected by the user through the user interface 16. At 202, an optional pre-wash phase may be run in which liquid is recirculated by the liquid recirculation system through the spray system 28 one or more times. A wash phase may be initiated at 204 in which liquid is again recirculated by the liquid recirculation system through the spray system 28 one or more times. Both the wash phase 204 and the optional pre-wash phase may include recirculating liquid heated in the sump 38 by the heating element 50 and/or a treating agent, such as a detergent. During either or both of 202 and 204, the diverter valve 76 may control the flow of liquid to provide liquid from the liquid supply to the sump 38 for recirculation through the liquid recirculation system and spray system 28.

At 206, liquid collected in the sump 38 may be drained by the drain pump 44 and the diverter valve 76 may be controlled by the controller 14 to provide liquid to the sump 38 through the pump assembly supply conduit 74. The fresh water from the liquid supply may be recirculated by the recirculation system through the spray system 28 one or more times at 208 to rinse the items in the treating chamber 20. Following the rinsing at 208, the drain pump 44 may again be optionally operated to drain liquid collected in the sump 38. The rinse at 208 may be repeated one or more times depending on the soil load of the dishes. The soil load may be determined manually based on user input or automatically using one or more sensors, such as an optical sensor, for example.

At 210, the diverter valve 76 may be controlled by the controller 14 to provide liquid to the ozone generator supply conduit 72. The controller 14 may also control the ozone generator 62 to generate ozone by electrolysis of the water supplied from the liquid source through the ozone generator supply conduit 72. Ozonated water generated by the ozone generator 62 may travel from the ozone generator 62 to the second set of openings 68, 69, 70 in the spray system 28 through the ozone supply tube 66. Ozonated water may be supplied continuously to the treating chamber 20 for a predetermined period of time or intermittently for a predetermined number of times. It will be understood that during emission of the ozonated water a mixture of ozone gas and ozone gas dissolved in water may be applied to the items located within the treating chamber 20 and the various surfaces of the dishwasher 10 within the treating chamber 20.

At 212, the diverter valve 76 may again selectively provide liquid from the liquid supply to the pump assembly 40 for recirculation by the liquid recirculation system through the spray system 28 for rinsing the items in the treating chamber 20. The heater 50 may also be run at 212 during and/or after the rinsing to facilitate drying the dishes. At 214, the drain pump 44 may be operated so as to drain liquid that has collected in the sump 38. It is also within the scope of the invention for additional draining of the liquid collected in the sump 38 to occur prior to the rinse at 212. While the supply of ozone to the treating chamber 20 at 210 is illustrated as part of a phase of a selected treating cycle, it is also within the scope of the invention for the supply of ozone to be provided as part of an independent cycle of operation.

Liquid that is recirculated through the liquid recirculation system, even after a final rinse, contains organic matter that may react with ozone, thus decreasing the amount of ozone applied to the dishes, and may also clog the ozone generator 62. Providing a separate ozone spraying system 64 which uses an ozonating circuit independent of the liquid recirculation circuit decreases the amount of organic matter the ozonated water encounters prior to being emitted through the second set of openings 68, 69, 70 into the treating chamber 20, increasing the amount of ozone available to react with material in the treating chamber 20. In addition, by not flowing recirculated liquid through the ozone generator 62, the potential for the build-up of material within the cell, which may decrease the lifespan of the ozone generator 62 and/or its efficiency, may also be decreased. The ozonating system 60 may rely on the pressure of the liquid supply at the installation site for pumping the ozonated water through the ozone generator 62 and ozone spraying system 64.

Figure 4:
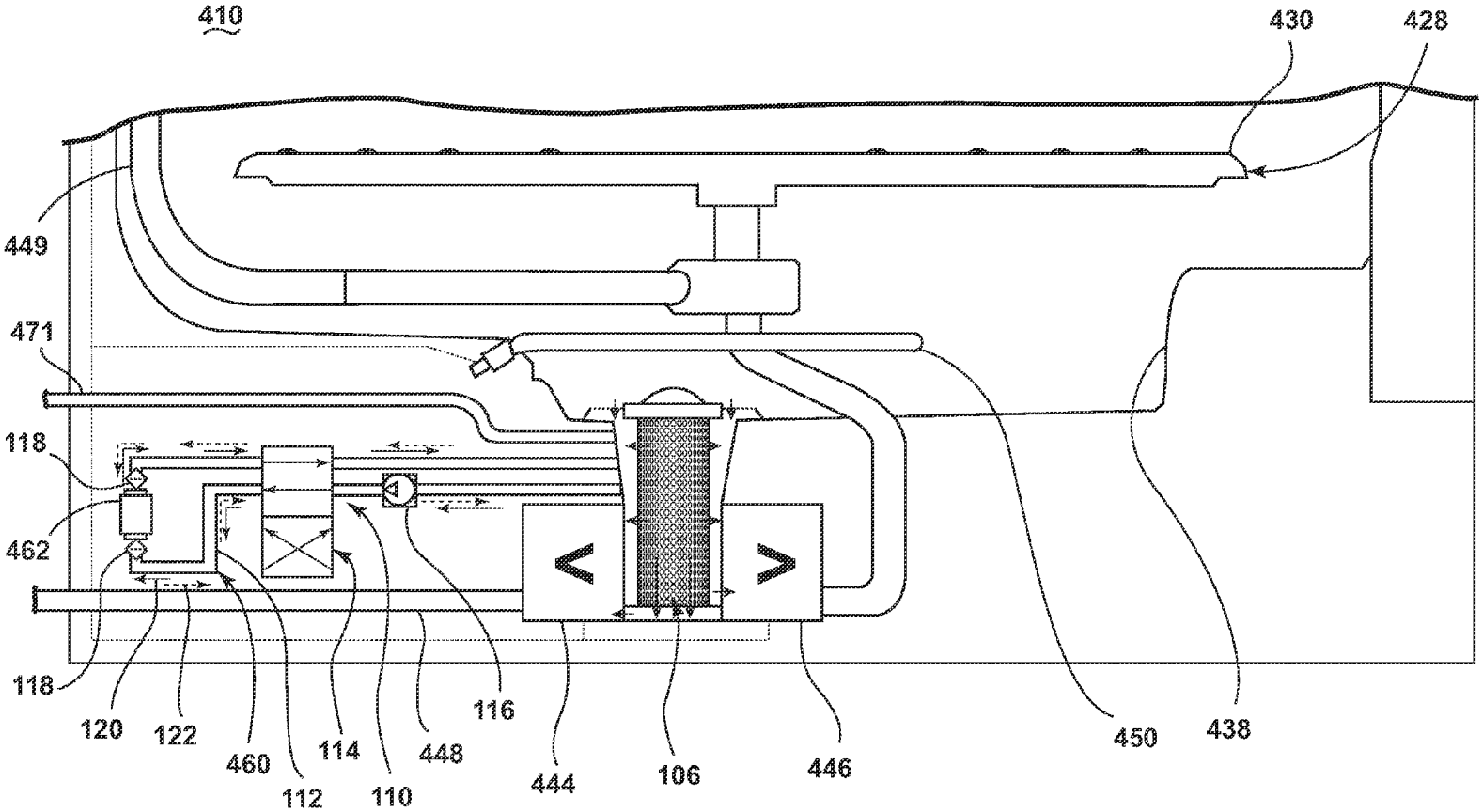
FIG. 4 is a schematic cross-sectional view of a portion of an automatic dishwasher according to a third embodiment of the invention.

FIG. 4 illustrates a second embodiment comprising a dishwasher 410, which is similar to the dishwasher 10 except for the ozonating system 460 is fluidly coupled with the liquid recirculation system. Therefore, elements of the dishwasher 410 similar to the dishwasher 10 will be numbered with the prefix 400. For the sake of simplicity, only a bottom portion of the dishwasher 410 is illustrated in FIG. 4.

As illustrated in FIG. 4, the liquid recirculation system includes a filter assembly 106 which may be fluidly coupled with the liquid supply conduit 471 for receiving water from the liquid supply and the sump 438 for filtering liquid collected in the sump 438. The filter assembly 106 may also be coupled with the drain pump 444 for draining liquid collected within the filter assembly 106 and the recirculation pump 446 for recirculating liquid from the filter assembly 106 through the liquid recirculation system. Circulation of liquid from the filter assembly 106 by the recirculation pump 446 through the spray system 428 to the treating chamber 420 where the liquid can be collected in the sump 438 and flow back to the filter assembly 106 for recirculation defines a liquid recirculation path or circuit within the dishwasher 410.

The ozonating system 460 may be fluidly coupled with the liquid recirculation path for selectively providing ozonated water to the liquid recirculation path according to a cycle of operation. The ozonating system 460 includes a reverse flow system 110 which couples the ozone generator 462 with the liquid recirculation path through the filter assembly 106 by a liquid circuit 112. In this manner, the reverse flow system 110 forms an ozone circuit which forms a bypass to the recirculation path to provide liquid to the ozone generator 462 and ozonated liquid to the recirculation path. The liquid circuit 112 includes at least one valve 114 for controlling the direction of the flow of liquid through the liquid circuit 112. The valve 114 may be a four-way valve, as illustrated, or a combination of multiple valves may be used. The valve 114 may be operably coupled with the controller 414 for selectively controlling the flow of liquid through the liquid circuit 112. The liquid circuit 112 may also include an ozone generator pump 116, which may be a reversible pump, for pumping liquid through the liquid circuit 112 in both directions. The liquid circuit 112 may also include one or more filters 118 on either side of the ozone generator 462 for filtering the liquid supplied to the ozone generator 462 regardless of which direction the liquid is flowing through the liquid circuit 112.

During a cycle of operation, the controller 414 may control the operation of the valve 114 and the ozone generator pump 116 to pump liquid through the liquid circuit 112 and the ozone generator 462 in a first direction, as illustrated by solid flow arrows 120. The controller 414 may also control the valve 114 and ozone generator pump 116 to pump liquid through the liquid circuit 112 and the ozone generator 462 in the reverse direction, as illustrated by dashed flow arrows 122. The controller 414 may control the operation of the valve 114 and the ozone generator pump 116 to alternate the direction of flow of liquid through the liquid circuit 112 and the ozone generator 462 multiple times during a cycle of operation at predetermined time intervals and/or to alternate the direction of flow with each cycle. In one example, the direction of flow through the liquid circuit 112 and ozone generator 462 may be reversed every 4-10 min. during the generation of ozone. In this manner, the flow of liquid through the liquid circuit 112 may be reversed to back flush the ozone generator 462 before, during and/or after the generation of ozone.

The ozonating system 460 may be used to provide ozonated water to the treating chamber 420 through the liquid recirculation system and the spray system 428 according to any known cycle of operation. In one example, the ozonating system 460 may be used to provide ozonated water to the treating chamber 420 according to the method 200 illustrated in FIG. 3 above. The liquid circuit 112 may provide fresh water to the filter assembly 106 from the liquid supply that has not been circulated through the liquid recirculation system to the ozone generator 462 for generating ozonated water. Additionally or alternatively, the liquid circuit 112 may provide the ozone generator 462 with liquid that has been recirculated through the liquid recirculation system one or more times. In one example, the flow of liquid through the liquid circuit 112 may be reversed at the beginning and/or end of a phase in which liquid is recirculated to back flush the ozone generator 462. In another example, the ozone generator 462 may be back flushed intermittently during the course of a phase in which liquid is recirculated. In another example, the ozone generator 462 may be back flushed as part of a separate ozone generator cleaning cycle.

Typically, a recirculation pump in a dishwasher will have a flow rate of approximately 43 liters per minute (L/min.) and a pressure of approximately 2 psi. This flow rate and pressure provide the recirculation pump 446 with sufficient liquid to treat the dishes in the treating chamber 420 according to a cycle of operation to provide an acceptable treating performance within an acceptable period of time. The ozone generator 462 is in the form of a PEM cell, which typically requires a much lower flow rate and a much higher pressure than is usually provided by typical dishwasher recirculation pumps for efficient operation. PEM cells typically operate most efficiently at flow rates in the range of about 1-3 L/min. and pressures in the range of about 10-30 psi. In one example, a typical PEM cell requires a flow rate of about 2 L/min. and a pressure of about 20 psi for efficient operation. The lower flow rate facilitates the electrolysis reaction which generates the ozone from the supplied water and the higher pressure overcomes the restrictive nature of the PEM cell. PEM cells are generally so restrictive in nature that a typical recirculation pump does not have enough pressure to pump liquid through a PEM cell. The ozone generator pump 116 may be configured to provide suitable flow rates and pressures through the liquid circuit 112 for efficient operation of the PEM cell, based on the specifications of the PEM cell, during generation of ozone by the ozone generator 462.

Ozonated water is typically supplied to the treating chamber 420 as a final or sanitizing rinse, and not necessarily to facilitate the removal of debris from the dishes. Most of the debris is removed from the dishes during the wash, rinse and optional pre-wash phases of a cycle of operation. During the supply of ozonated water to the treating chamber 420, the ozone generator pump 116 may be configured to provide liquid to the ozone generator 462 at a flow rate and pressure that is sufficient for operation of the ozone generator 462 and also for circulation to the spray system 428 for emission into the treating chamber 420. Alternatively, the ozone generator pump 116 may be configured to supply liquid to and from the ozone generator 462 and the filter assembly 106 and the recirculation pump 446 may be used to pump the ozonated water from the filter assembly 106 to the spray system 428.

As illustrated in FIG. 4, the dishwasher 410 is provided with a separate recirculation pump 446 and ozone generator pump 116 due to the difference in flow rates and pressures required for efficient operation of the liquid recirculation system for circulating liquid during washing and rinsing phases and the efficient operation of the ozone generator 462. It is also within the scope of the invention for a single pump to be used that is able to selectively operate at different flow rates and pressures.

Liquid that is recirculated through the liquid recirculation system may include debris, even after passing through the filter assembly 106. This debris may react with the ozone generated by the ozone generator 462, decreasing the amount of ozone that is eventually applied to the dishes in the treating chamber 420. The debris may also accumulate within the ozone generator 462, restricting the flow of liquid through the ozone generator 462 and thus decreasing the operating efficiency of the ozone generator 462. In some cases, the ozone generator 462 may become clogged with the accumulation of debris over time to the point where the ozone generator 462 can no longer generate ozone and/or sufficient liquid can no longer flow through the ozone generator 462. Reversing the flow of liquid and back flushing the ozone generator 462 facilitates removal of debris from the ozone generator 462. Flushing out the ozone generator 462 by reversing the flow of liquid may increase the overall lifespan of the ozone generator 462 and also the efficiency of the ozone generator 462 over the lifespan of the dishwasher and during individual cycles of use.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a dishwasher having a treating chamber, a recirculating system for recirculating liquid for treating dishes in the treating chamber, and an ozone generator having a proton exchange membrane (PEM) for generating ozone, the method comprising:

during a sanitizing rinse, introducing ozonated liquid into the treating chamber by passing liquid through the PEM to generate the ozonated liquid and then providing the ozonated liquid into the treating chamber; and back flushing the PEM to clean the PEM by reversing a direction of liquid passing through the PEM during the introduction of the ozonated liquid into the treating chamber during the sanitizing rinse.

2. The method of claim 1 wherein the reversing the direction further comprises reversing the direction for each introduction of ozonated liquid.

3. The method of claim 1 wherein the reversing the direction further comprises reversing the direction at predetermined time intervals.

4. The method of claim 1 further comprising washing the dishes by recirculating detergent liquid to the treating chamber.

5. The method of claim 1 wherein the introducing the ozonated liquid is separate from a wash phase for treating the dishes.

6. The method of claim 5 wherein the introducing the ozonated liquid occurs after the wash phase.

7. The method of claim 1 wherein the reversing the direction is conducted during a recirculation of liquid by the recirculation system during the sanitizing rinse.

8. The method of claim 7 wherein the reversing the direction is conducted at a beginning of the recirculation of liquid by the recirculation system during the sanitizing rinse.

9. The method of claim 7 wherein the reversing the direction is conducted at an end of the recirculation of liquid by the recirculation system during the sanitizing rinse.

10. The method of claim 1 wherein the reversing the direction comprises diverting at least a portion of the recirculated liquid from the recirculating system through the proton exchange membrane.

* * * * *